US005383597A

United States Patent [19]

Sooriakumar et al.

[11] Patent Number: 5,383,597

[45] Date of Patent: Jan. 24, 1995

[54] APPARATUS AND METHOD FOR CONTROLLING THE CONE ANGLE OF AN ATOMIZED SPRAY FROM A LOW PRESSURE FUEL INJECTOR

[75] Inventors: Kathirgamasundaram Sooriakumar, Colorado Springs, Colo.; Debojit Barua, Troy; Marcus W. Fried, Belleville, both of Mich.

[73] Assignee: Ford Motor Company, Dearborn, Mich.

[21] Appl. No.: 102,920

[22] Filed: Aug. 6, 1993

[51] Int. Cl.[6] ..... F02M 61/16; F02M 63/00

[52] U.S. Cl. ..... 239/5; 239/543; 239/544; 239/552; 239/584; 239/590.3; 239/590.5; 239/596; 239/DIG. 19

[58] Field of Search ..... 239/5, 533.12, 533.13, 239/533.14, 552, 584, 585.1, 590.3, 590.5, 596, 601, DIG. 19, 543, 544

[56] References Cited

U.S. PATENT DOCUMENTS

| | | | |
|---|---|---|---|
| 2,386,918 | 10/1945 | Timpson | 239/590.3 X |
| 3,591,907 | 7/1971 | MacMunn . | |
| 3,831,860 | 8/1974 | Gullaksen et al. . | |
| 4,364,523 | 12/1982 | Parkison et al. . | |
| 4,647,013 | 3/1987 | Giachino et al. . | |
| 4,808,260 | 2/1989 | Sickafus et al. . | |
| 4,828,184 | 5/1989 | Gardner et al. . | |
| 4,907,748 | 3/1990 | Gardner et al. . | |
| 4,925,111 | 5/1990 | Foertsch et al. | 239/585.1 X |
| 5,128,645 | 7/1992 | Suda . | |
| 5,163,621 | 11/1992 | Kato et al. . | |

FOREIGN PATENT DOCUMENTS

| | | | |
|---|---|---|---|
| 4112150 | 3/1992 | Germany . | |
| 502540 | 11/1954 | Italy . | |
| 667463 | 3/1952 | United Kingdom | 239/533.12 |
| 2046835 | 11/1980 | United Kingdom . | |

*Primary Examiner*—William Grant

*Attorney, Agent, or Firm*—Richard D. Dixon; Roger L. May

[57] ABSTRACT

A fuel injector for improving the atomization quality of fuel flowing into an internal combustion engine, includes a body having first and second turbulence cavities defined therein. First and second supply orifices in the body are coupled into their corresponding turbulence cavities for guiding the flow of fuel thereinto. First and second metering orifices in the body are coupled from corresponding first and second turbulence cavities for exhausting the atomized fuel therefrom in first and second fuel flows. One rim of each supply orifice is paired with a second rim of an adjacent metering orifice in order to produce a turbulence within the turbulence cavity. The metering orifice rim is spaced downstream by a distance y and laterally offset by a distance x from the supply orifice rim such that x/y is greater than 0.1. The fuel flowing from the first and second metering orifices includes lateral momentum components that cooperate to control the resultant cone angle of the fuel flowing from the injector. A plurality of hillocks are located within the turbulence cavity to enhance atomization. A method of operation for the apparatus is also provided.

19 Claims, 3 Drawing Sheets

APPARATUS AND METHOD FOR CONTROLLING THE CONE ANGLE OF AN ATOMIZED SPRAY FROM A LOW PRESSURE FUEL INJECTOR

BACKGROUND OF THE INVENTION

1. Field of the Invention

This invention relates to nozzles for controlling the directional flow and fine atomization of liquids expelled therethrough, and more particularly to nozzles used for atomizing fuel before injection into an internal combustion engine.

2. Prior Art

Stringent emission standards for internal combustion engines suggest the use of advanced fuel metering techniques that provide precise delivery of atomized fuel into a localized volume or area of the manifold or engine. Such precise delivery of the fuel not only improves the emission quality of the exhaust, but also improves the cold start capabilities, fuel consumption and performance. The quality of atomization of the fuel, which includes both cone angle and fuel droplet size, is a significant factor in overall engine performance.

Meaningful improvements in performance and emissions levels can be achieved by controlling the cone angle of the atomized fuel injected into the manifold. As used herein, the term cone angle is defined as the angle of the atomized spray with respect to the central axis of the injector or one of the major orifices defining the injector.

In most engine designs it is desirable to focus the atomized fuel throughout the central portion of the intake manifold so that it will not wet the cylinder walls. In other cases, a more diffused cone angle can allow improved performance in engines requiring specific combustion chamber configurations.

Smaller fuel droplets generally have greater volumes of surrounding air as required to complete the combustion process. Smaller fuel droplets also promote a more homogeneous mixture of fuel and air, which in turn provides a faster, more complete combustion process. This improved combustion process reduces hydrocarbon (HC) and carbon monoxide (CO) emissions which are generally caused by localized high fuel to air ratios produced from heterogeneous injector sprays.

Micromachined fuel injectors have the potential for realizing significant improvements in the quality of the atomized fuel utilized by the internal combustion engine. As an example of silicon micromachined (SMM) devices that are used for atomizing liquids, U.S. Pat. No. 4,828,184 discloses the use of silicon plates having openings for metering the fuel flow. A first opening in a first silicon plate is offset from a second opening in a second silicon plate juxtaposed with the first silicon plate. The area between the first and second openings has a reduced thickness so as to form a shear gap for accelerating the flow of the fuel through opposing shear gaps in a direction substantially parallel to plane of the first and second plates. Such shear flow causes turbulence and liquid dispersion advantages for atomizing the fuel before it is propelled into the combustion chamber of an internal combustion engine.

SUMMARY OF THE INVENTION

A fuel injector nozzle having improved cone angle and atomization control includes a body having first and a second turbulence cavities defined therein, and first and second supply orifices coupled into corresponding turbulence cavities for guiding the flow of fuel thereinto. First and second metering orifices in the body are coupled from corresponding turbulence cavities for exhausting the atomized fuel therefrom in first and second fuel flows. Vortex generators are located adjacent the supply orifices for generating turbulence in the liquid immediately adjacent the corresponding metering orifices for enhancing the atomization of and for inducing in the fuel flow a lateral momentum component generally transverse to the direction of the fuel flow. Each vortex generator includes a first rim of the supply orifice and is paired with a second rim of an adjacent metering orifice. The second rim is located downstream by a distance y and laterally offset by a distance x from the first rim such that the x/y ratio is greater than 0.1. The supply orifices, vortex generators, turbulence cavities and metering orifices are sized and spaced in the body such that the lateral momentum components in the first and second fuel flows cooperate to control the resultant cone angle of the fuel flowing from the injector.

A plurality of hillocks may be positioned in the turbulence cavity for imparting additional turbulence to the fuel flow and thereby improving the quality of atomization.

A nozzle in accordance with the present invention may be fabricated using either silicon micromachine, selective metal etching, or conventional metal machining techniques and produces a liquid flow of high velocity, and relatively small diameter fuel droplets. A method in accordance with the principles of operation of the fuel injector are also disclosed.

It is therefore a primary object of the present invention to define a structure and method that will introduce turbulent flow at the optimum location in an atomizing nozzle so as to control the cone angle of the ejected atomized liquid while maintaining a minimum size of atomized droplets of fuel.

BRIEF DESCRIPTION OF THE DRAWINGS

Other objects, features and advantages of the present invention will be apparent from studying the written description and the drawings in which:

FIG. 3 illustrates a bottom view of the top turbulence generator plate, while

FIG. 8 illustrates a bottom view of the top turbulence generator plate, while

FIG. 13 illustrates a bottom view of the top turbulence generator plate, while

Figure 1:
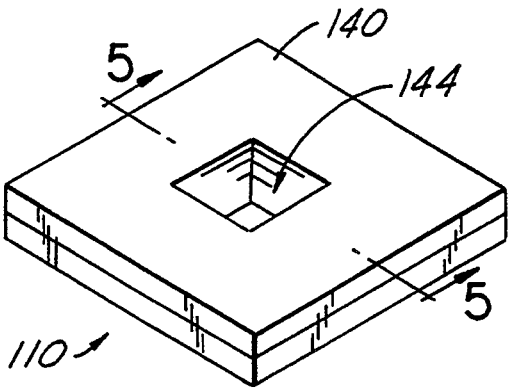
FIGS. 1 and 2 illustrate top and bottom perspective views of a first preferred embodiment of an automotive fuel injector nozzle in accordance with the present invention.
Figure 2:
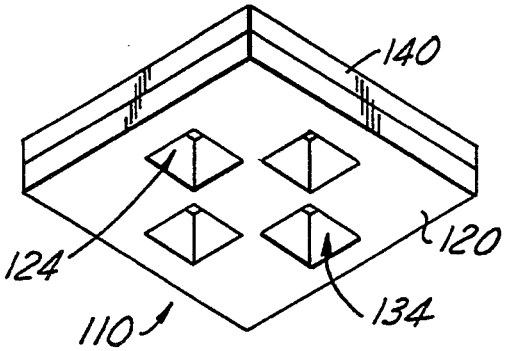
Figure 3:
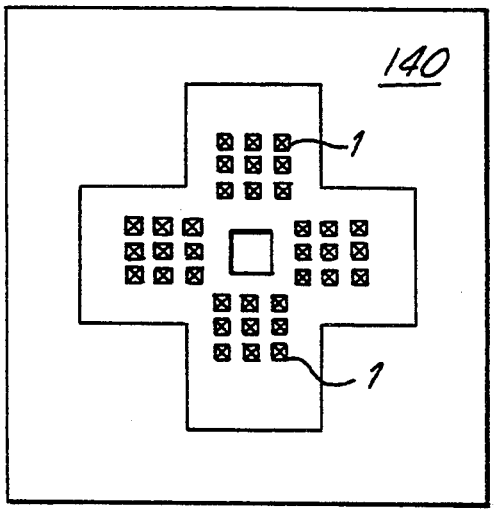
Figure 4:
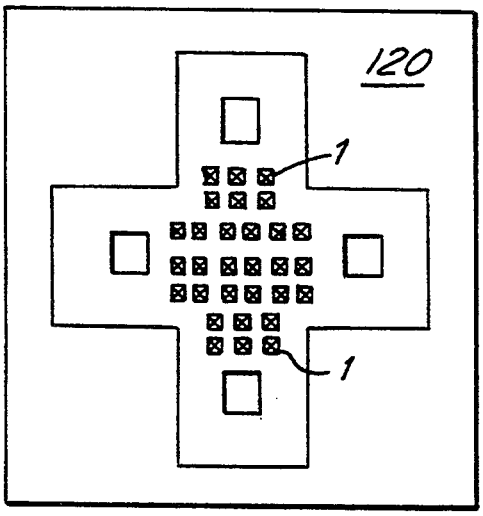
FIG. 4 illustrates a top view of the bottom metering plate of the first preferred embodiment shown in FIGS. 1 and 2.

These drawings are provided primarily for purposes of illustration of the invention and its operation and may not always be exactly to scale in every dimension.

BACKGROUND TECHNICAL DISCUSSION

It is well known that supplying energy to a liquid may improve the atomization of the liquid jets flowing from an exhaust orifice. It is also well known that structures projecting into the liquids flowing through an orifice can be used to deflect and direct the exhausted liquid. The present invention combines these interactions to improve the atomization quality of the exhausted liquid by developing turbulent eddies upstream of a metering plate in the tip of the fuel injector.

A turbulent flow condition in a liquid flowing through a confined area can be created in three possible ways. First, the rapid liquid flow past a-solid wall can lead to unstable, self-amplifying velocity fluctuations. These fluctuations form near the wall and then spread into the remainder of the internal liquid flow or stream. Second, velocity gradients between a fast moving liquid stream and a slow moving liquid stream can produce turbulent eddies. Third, liquid flow past a solid body or sharp angularity in the internal flow causes eddies to setup in the wake of the body. This is the primary mechanism which will be implemented in the present invention.

In such cases turbulent flow arises from some instability which is present in laminar flows at high Reynolds Numbers. The transition to turbulence is usually initiated by an instability which is two dimensional in simple cases. These two dimensional instabilities produce secondary motions, not parallel to the mean liquid flow, which are three dimensional and also unstable. These three dimensional instabilities are formed locally and when several local three dimensional instabilities interact, and a large turbulent field is produced.

Liquids flowing past a solid object that produces turbulence can be described with regard to several common characteristics. Turbulent flows are very random and irregular. Turbulent flows exhibit diffusivity of turbulence which promotes mixing, increases heat and mass transfer rates, and may increase and redirect resulting momentum. A flow is not turbulent unless velocity fluctuations are present throughout the field. Turbulent flows usually originate due to some instability in laminar flow, but turbulent flows are always created at high Reynolds Numbers. Turbulence is both three dimensional and rotational, therefore creating vortices. Vortex stretching is the phenomenon which causes turbulence to be three dimensional. Without vortex stretching, there would be no fluctuation of the eddies and the eddies would therefore be two dimensional and non-turbulent.

Vortex shedding at angularities (sharp corners) can induce strong eddie currents at Reynolds Numbers as low as 300–400. The sharpness of these angularities is very important, since eddies are shed much more readily from sharp corners then from smooth ones. Sharp corners having included angles of less than 90 degrees are preferred.

The present invention will utilize these physical phenomenon relating to turbulence generators in order to induce additional energy into liquid flowing past two or more protruding objects. The energy introduced in the liquid will be isolated and then utilized in order to induce lateral momentum components in the resulting liquid flow and to promote the fine atomization of the liquid as it is metered and then ejected from an orifice. While the preferred embodiments of the present invention will be illustrated with respect to fuel injectors for use with an internal combustion engine, the same embodiments could be used for injecting other liquids with only minor modifications to account for differences in viscosity and surface tension of the liquids.

DESCRIPTION OF THE PREFERRED EMBODIMENTS

A first preferred embodiment of a fuel injector nozzle, which is illustrated in FIGS. 1–5 and designated by the reference numeral 110, includes a turbulence generator plate 140 and a metering plate 120. The compound silicon micromachined orifice plates can be manufactured from silicon wafers using well known semiconductor processing techniques, with one plate being bonded to the top of the other. In the alternative, the invention may also be constructed of various metal plates, including copper-nickel and nickel-stainless, without departing from the teachings of the invention. However, the silicon construction is preferred because of the processing capability to maintain 10 micron alignment accuracy, the ease and strength of silicon to silicon bonding, and the ease of achieving sharp acute angles at the edges of the operative orifices.

Figure 5:
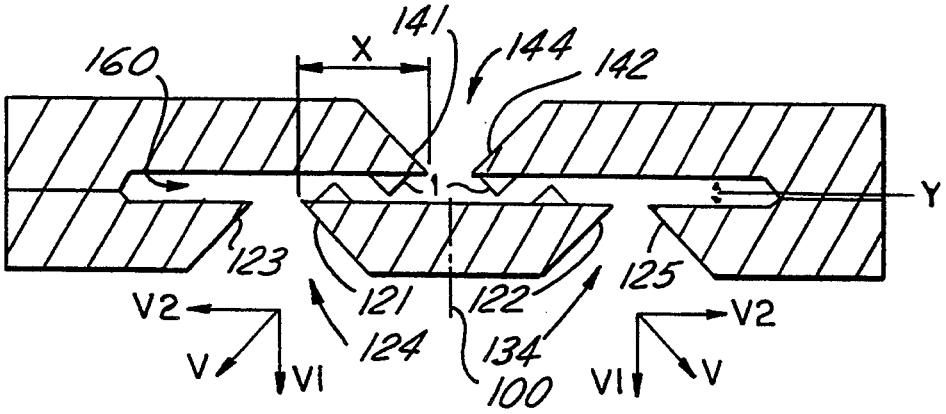
FIG. 5 illustrates a simplified cross sectioned view of the first preferred embodiment of the present invention taken along section lines 5—5 in FIG. 1.
Figure 6:
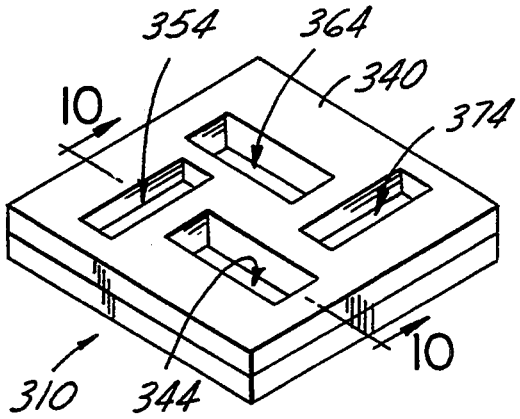
FIGS. 6 and 7 illustrate top and bottom perspective views of a third preferred embodiment of an automotive fuel injector in accordance with the present invention.
Figure 7:
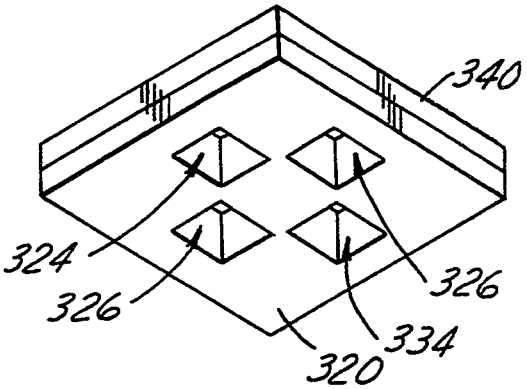

With specific reference to FIG. 5, the turbulence generator plate 140 includes a single supply orifice 144 having a generally square shape that is located along a central axis 100 of the device. The supply orifice 144 opens into a centrally located turbulence cavity 160 formed between the adjacent internal surfaces of the turbulence generator plate 140 and the metering plate 120. Also coupling into the turbulence cavity are four metering orifices, with only 124 and 134 illustrated in FIG. 5 for sake of clarity, each having a generally square shape.

Supply orifice 144 is defined by beveled surfaces that include sharp edges 141 and 142 adjacent the turbulence cavity 160. In a similar manner, metering orifice 124 is defined by beveled surfaces that include sharp edges 121 and 123 adjacent the turbulence cavity 160. Similar sharp edges 122 and 125 are defined by the beveled surfaces that form metering orifice 134 as the orifice couples with the turbulence cavity 160. These beveled surfaces and edges form protrusions into the liquid flow that create the desired turbulence and vortices therein.

The offset of metering orifice 124 from the central flow axis 100, when taken in conjunction with the relative size of the supply orifice 144 and the metering orifice 124, create an overlap distance x that is defined as the distance between the sharp edge 141 and the sharp edge 121. Due to the symmetry of the first preferred embodiment, this same x offset is equal to the offset defined between the sharp edge 142 of the supply orifice 144 and the sharp edge 122 of the metering orifice 134. This x offset is measured only along a direction perpendicular to the central flow axis 100 and does not include any component that is parallel to the central axis.

A y dimension is defined as the effective height of the turbulence cavity 160 as measured between the corresponding sharp edges 141 and 121 or the sharp edges 142 and 122. In the first preferred embodiment the y offset is measured only along the direction of the central flow axis 100. The importance of the x and y dimensions for each of the elements in the plate will be discussed subsequently. While both edges are illustrated with the preferred acute angle, the principles of the present invention also work, with somewhat reduced effectiveness, with edges up to and including an included angle of approximately 90 degrees, as long as the edge is designed to create an effective eddy within the downstream section of the fuel flow.

With continuing reference to FIG. 5, turbulent eddies in the liquid flowing through the supply orifice 144 are formed in the turbulence cavity 160 due to the acute edges 141 and 142 on the turbulence generator plate 140. These eddies greatly aid in the breaking up of the liquid into droplets. The location of the eddies is critical in the atomization process of the liquid. If the design of the device can force an eddie to reside directly above the metering orifice 124 in the metering plate 120, the atomization should be greatly enhanced. As the size of the supply orifice 144 increases, the edge 141 of the supply orifice 144 will approach the edge 121 of the metering orifice 124 in the metering plate 120. As the effective diameter of the supply orifice 144 increases, the edge 142 of the orifice 144 approaches the edge of the exhaust orifice 134 in the metering plate 120. In this manner each eddie is forced to move outwardly from the central axis 100 of the supply orifice 144. At some point the eddie has moved too far from the central axis 100 and is no longer above the corresponding metering orifice in the lower metering plate 120. It is this relationship between the two orifices 144 and 134 (or 144 and 124) and the location of the eddies which may be adjusted to produce a spray having the lowest SMD (Sauder Mean Diameter).

A high Reynolds Number is not necessary to achieve good atomization. However, the flow must not be overly restricted, thereby creating a very low Reynolds Number, since the restricted flow does not result in a lower SMD. In the extreme, if the eddies are placed outside of the metering orifices in the lower plate, the SMD of the atomized liquid droplets tends to increase.

When the edge 141 of the upper orifice 144 lines up directly with the edge 121 of the metering orifice 124 in the metering plate 120, the x/y ratio will be equal to zero. As the supply orifice 144 is reduced in size, the edge 141 moves inwardly, and the x/y ratio becomes more positive. As the supply orifice 144 becomes larger, the outer edge 141 moves outwardly (away from a central axis 100), and after the x dimension passes below zero the x/y ratio becomes negative.

Given this definition of the x/y ratio, measurements can be taken along the center line 100 of the supply orifice 144, approximately three inches downstream from the injector device. With the fuel pressure remaining constant at 40 psi, and with a constant Stoddard fluid temperature of 70° F., as the x/y ratio increases from −2 toward 0.5, the resulting SMD of the spray decreases rapidly from about 120 microns to 65 microns for a standard y dimension of 100 microns, with a best case of about 55 microns for a y dimension of 75 microns. While the SMD decreases dramatically for x/y ratios moving from a negative 2 toward a positive value of 0.5, no significant improvement is apparent for x/y ratios beyond 0.5 and most of the decrease in SMD is realized with an x/y ratio of 0.1 and greater. Therefore, in order to create the optimum or smallest atomization for given orifice sizes, the relative separation distance between the closest edge of the supply orifice 144 in the upper plate 140 and the closest edge of the metering orifice 124 (and 134) in the lower metering plate 120 should be at least one-half the height of the gap defined by the turbulence cavity 160. However, analysis indicates that increasing the x/y ratio beyond approximately 5 significantly increases the size of the injector but does not significantly improve the atomization of the liquid flowing therethrough. Injector designs employing an x/y ratio greater than approximately 5 are therefore used only for special applications requiring unusual performance parameters.

This optimum range for the x/y ratio is predicted from the hypothetical analysis of the location of the eddies as previously discussed. At x/y equals 0.5, the eddies created by the sharp corners 141 and 142 forming the supply orifice 144 are located in the optimal position in the turbulence cavity above the metering orifices 124 and 134. As the sharp corner 141 is moved outside of the metering orifice 124, that is in a negative x direction, the eddie becomes less effective and the atomization size of the resulting droplets increases. As a result of experimentation, the optimum orifice plate geometry was produced with an SMD of 53 microns, a flow rate of 6.37 liters per hour, producing a cone angle of 41° with an x/y ratio of 2.0. This SMD of 53 microns is approximately 62% smaller than the SMD produced by a base line SMM injector (approximately 140 microns).

As the gap height y decreases, the SMD decreases for a given value of the x/y ratio. If this result is extrapolated, then the smaller the gap height y becomes, the smaller the SMD of spray will become. This may be explained in one of several ways. First, the exhaust droplets may become smaller because they are being forced through a smaller opening, thus creating shear forces on a larger surface area of the liquid. Another explanation may be that the eddies which are formed by the sharp corners of the supply orifice are being moved closer to the metering orifices, causing more random motion-immediately above the metering orifices. This would put more energy into the liquid immediately above the metering orifices, which in turn provides a better atomization of the liquid.

In general terms, it may be concluded that as the x/y ratio increases, the flow rate generally decreases because an increased restriction to the flow of the liquid results. When the x/y ratio is negative, the supply orifice in the upper plate completely exposes the metering orifices in the lower plate, thus causing no restriction to the liquid flow. As the x/y ratio increases into positive numbers, the supply orifice size is reduced for a constant gap height, and the metering orifices begin to be covered up so that the liquid must turn a sharp corner as it exits the metering orifices in the lower plate. Therefore, as the x/y ratio increases, the flow rate decreases.

In accordance with the first preferred embodiment of the present invention, each of the metering orifices 124 and 134 are offset from the central flow axis 100 which is centered within the supply orifice 144 such that the fuel flowing from the supply orifice 144, through the turbulence cavity 160, and exiting either of the metering orifices will include momentum components both parallel with (v1) and perpendicular (v2) to the central flow axis 100 of the device. In this first preferred embodiment the momentum component (v2) is away from the central flow axis 100 in order to increase the effective cone angle of the liquid exiting the metering orifices 124 and 134.

In the geometry used for the first preferred embodiment as illustrated in FIGS. 1–5, the optimum x/y ratio is 2 which includes an x dimension of 200 microns and a y dimension of 100 microns. The size of the supply orifice 144 is 100 microns square, while the size of the metering orifices is 212 microns square. This configuration produces SMD of 55 microns and a cone angle of approximately 40 degrees. The injector was fabricated from a silicon wafer having a crystal orientation of 100 and a thickness of approximately 400 microns. The angles of the vortex inducing edges can range from approximately 50 degrees to approximately 60 degrees, with 54 to 55 degrees being the preferred angle for purposes of the development of the present invention. The hillocks 1 illustrated within the turbulence cavity are optional, and their function will be discussed subsequently.

As the x/y ratio increases, the cone angle of the spray from the metering orifice also increases. This can be explained by the liquid turning the sharp corner of the supply orifice 144 in the upper plate. When the x/y ratio is highly negative, the metering orifices in the lower plate 120 are completely exposed to liquid and the liquid may flow directly through the metering orifices 124 and 134. All of the motion then is in the vertical direction through both orifices. However, as the x/y ratio becomes more positive and the flow is restricted, the liquid must turn the corner in the supply orifice 144, thus producing liquid momentum in the horizontal direction. It is this horizontal momentum that creates the increased cone angle. As with the droplet size experiments, the cone angle appears to reach a maximum at an x/y ratio approximating 0.5, and remains relatively constant as the x/y ratio increases beyond this value.

For a given x/y ratio, the cone angle is generally unaffected by the size of the metering orifices 124 and 134 in the lower plate 120. However, the cone angle does change as a function of the gap height y. As the cone angle is reduced, the SMD of the spray increases. As the cone angle is reduced by increasing the size of the supply orifice 144, thereby causing the x/y ratio to become smaller (or more negative), the SMD of the spray becomes larger. Therefore, as a general rule, as the cone angle increases, the size of the droplets in the spray decreases.

It is also apparent that as the fuel pressure increases, the droplet size decreases. This is predictable since more energy is being forced into the liquid, creating higher velocities and therefore high viscous shear forces, which provides more energy to break up the liquid and enhance the atomization.

Under dynamic pulsing conditions similar to those actually encountered in the operation of an internal combustion engine, it can be observed that the SMD of the liquid droplets is smaller in all sections of the spray pulse.

A second preferred embodiment of a fuel injector nozzle, which is illustrated in FIGS. 11–15 and designated by the reference numeral 210, includes a turbulence generator plate 240 and a metering plate 220. The turbulence generator plate 240 includes four supply orifices 244, 254, 264 and 247 having generally rectangular shapes that are spaced from the central axis flow 200 of the device.

Figure 13:
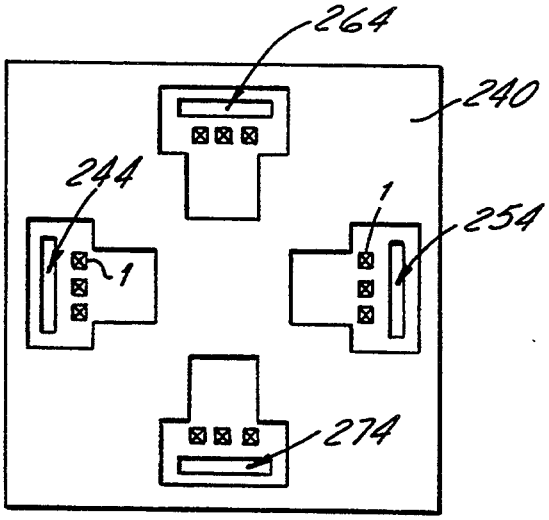
Figure 14:
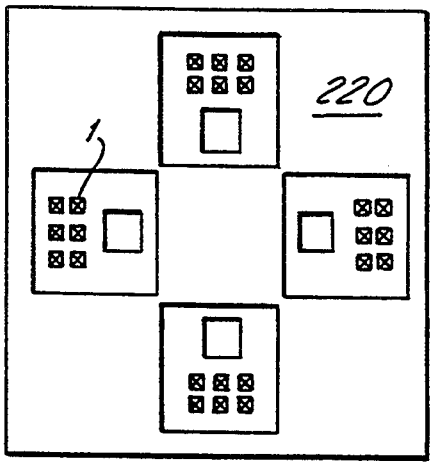
FIG. 14 illustrates a top view of the bottom metering plate of the embodiment shown in FIGS. 13 and 14.
Figure 15:
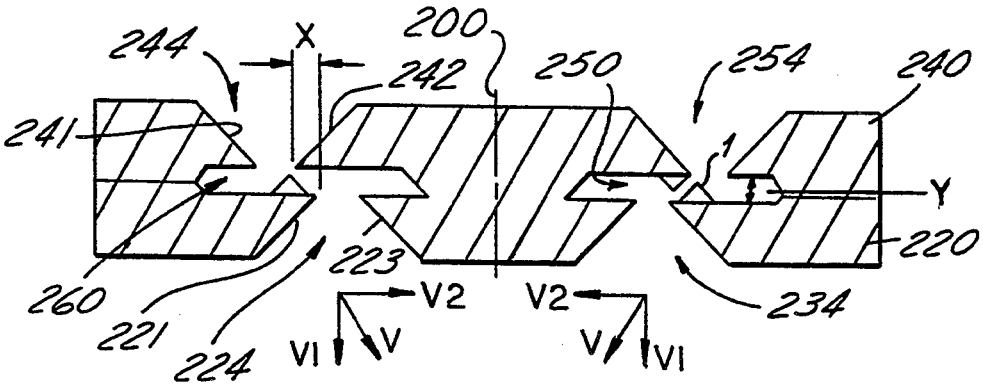
FIG. 15 illustrates a simplified cross sectioned view of the embodiment of the present invention taken along section lines 15—15 in FIG. 11.

As illustrated in FIG. 15, the supply orifice 244 opens into a turbulence cavity 260 formed between the adjacent internal surfaces of the turbulence generator plate 240 and the metering plate 220. Also coupling into the turbulence cavity 260 is a single metering orifice 224 having a generally square shape. As illustrated in FIGS. 13, 14 and 15, a flow axis for the fuel is defined of the supply orifice 244 and is offset in a direction away from the central flow axis 200 of the device.

Supply orifice 244 is defined by beveled surfaces that include sharp edges 241 and 242 adjacent the turbulence cavity 260. In a similar manner, metering orifice 224 is defined by beveled surfaces that include sharp edges 221 and 223 adjacent the turbulence cavity 260. In a similar manner, the supply orifice 254 opens into a turbulence cavity 280 formed between the adjacent internal surfaces of the turbulence generator plate 240 and the metering plate 220. Also coupling into the turbulence cavity 280 is a single metering orifice 234 having a generally square shape. The turbulence cavities 260 and 280 are not coupled in this embodiment. As illustrated in FIGS. 13, 14 and 15, a resulting flow axis of the fuel is defined by the supply orifice 254 and is offset in a direction away from the central flow axis 200 of the device.

The offset of metering orifice 224 from the supply orifice 244, when taken in conjunction with the relative size of the supply orifice 244 and the metering orifice 224, create an overlap distance x that is defined as the distance between the sharp edge 242 and the sharp edge 221. This x offset is measured only along a direction perpendicular to the central flow axis 200 and does not include any component that is parallel to the central axis.

Due to the symmetry of the second preferred embodiment, this same x offset is equal to the offset defined between the supply orifice 254 and metering orifice 234.

A y dimension is defined as the effective height of the turbulence cavities 260 and 280 as measured between the corresponding sharp edges 241 and 221. In the second preferred embodiment the y offset is measured only along the direction of the central axis 200. While all sharp edges are illustrated with the preferred acute angle, the principles of the present invention also work with edges up to and including an included angle of approximately 90 degrees, as long as the edge is designed to create an effective eddy within the downstream section of the fuel flow.

With continuing reference to FIG. 15, turbulent eddies in the liquid flowing through the supply orifices 244 and 254 are formed in the turbulence cavities 260 and 280 due to the acute edges on the turbulence generator plate 240.

In accordance with the second preferred embodiment of the present invention, each of the metering orifices 224 and 234 are offset from the flow axis of the corresponding supply orifice such that the fuel exiting either of the metering orifices will include momentum components both parallel with (v1) and perpendicular (v2) to the central axis 200 of the device. In this second preferred embodiment the momentum component v2 is toward the central flow axis 200 in order to reduce the effective cone angle of the liquid exiting the metering orifices 224 and 234. The opposing directions of the v2 components of the liquids exiting the adjacent metering orifices 224 and 234 will tend to cancel the naturally diverging cone angle of each orifice separately, and therefore the combination of the two orifices will reduce the overall cone angle of the orifice combination as measured with respect to the central flow axis 200.

Figure 12:
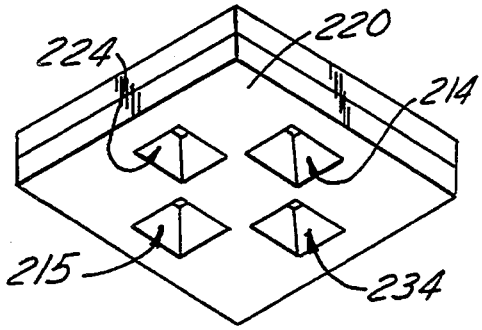

Of course, while the interaction of only two of the supply and metering orifices has been discussed, the remaining supply orifices 264 and 274 and their corresponding metering orifices 214 and 215 produce similar interactions and further reduce the effective cone angle of the liquid exiting the metering orifices illustrated in FIG. 12.

In the geometry used for the second preferred embodiment as illustrated in FIGS. 11–15, the optimum x/y ratio is 2, which includes an x dimension of 200 microns and a y dimension of 100 microns. The size of the supply orifices 244, 254, 264 and 274 is 200 microns by 400 microns, while the size of the metering orifices is 212 microns square. This configuration produces SMD of 90 microns and a cone angle of less than 20 degrees. The injector was fabricated from a silicon wafer having a crystal orientation of 100 and a thickness of 400 microns. The angles of the vortex inducing edges can range from approximately 50 degrees to approximately 60 degrees, with 54 to 55 degrees being used in the preferred embodiment. The hillocks 1 illustrated within the turbulence cavity are optional, and their function will be discussed subsequently.

Figure 8:
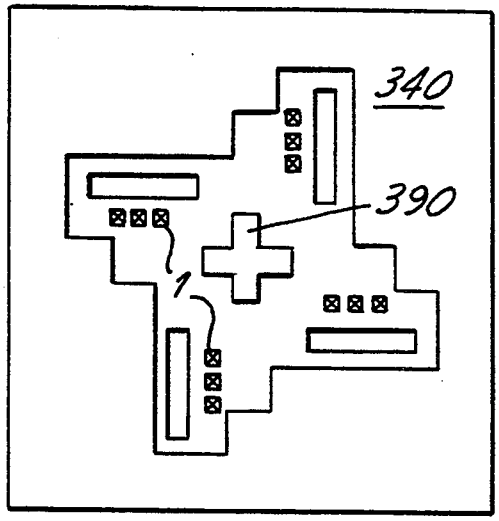
Figure 9:
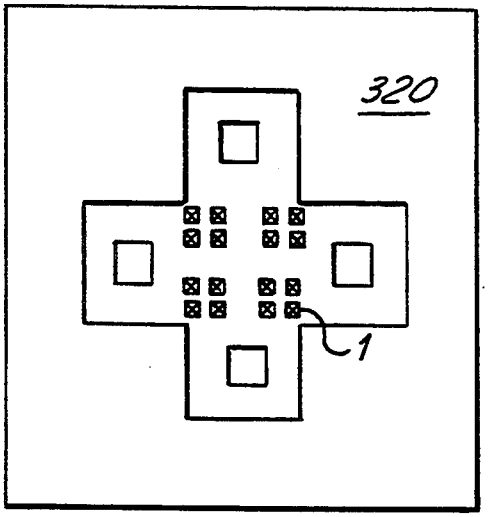
FIG. 9 illustrates a top view of the bottom metering plate of the embodiment shown in FIGS. 6 and 7.
Figure 10:
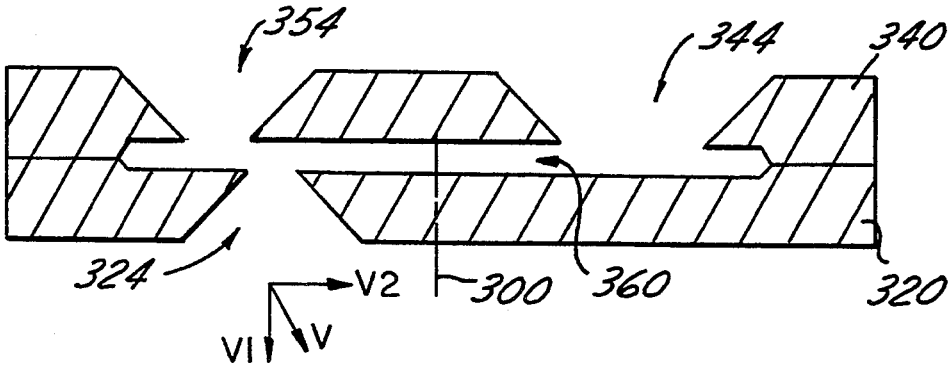
FIG. 10 illustrates a simplified cross sectioned view of the embodiment of the present invention taken along section lines 10—10 in FIG. 6.
Figure 11:
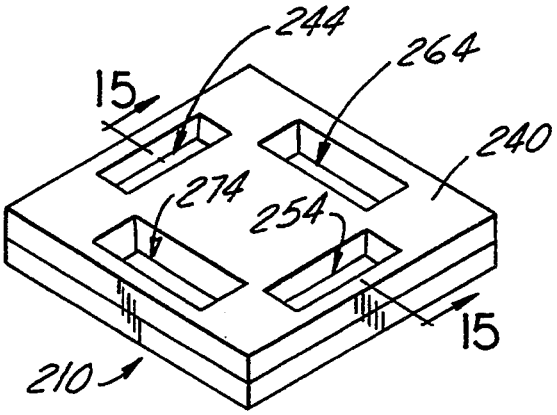
FIGS. 11 and 12 illustrate top and bottom perspective views of a second preferred embodiment of an automotive fuel injector in accordance with the present invention.

A third preferred embodiment of a fuel injector nozzle, which is illustrated in FIGS. 6–10 and designated by the reference numeral 310, includes a turbulence generator plate 340 and a metering plate 320. The turbulence generator plate 340 includes four supply orifices 344, 354, 364 and 374, and the metering plate 320 includes four metering orifices 324, 326, 334 and 336. The supply orifices are illustrated as having generally rectangular shapes and as being spaced from the central axis 300 of the device. In a selected cross section as illustrated in FIG. 10, the supply orifice 356 is coupled into a central turbulence cavity 360 that is also coupled to the other supply orifices 344, 364 and 374. In a similar manner, the metering orifice 324 is coupled to the central turbulence cavity 360 as are the other metering orifices 326, 334 and 336. The turbulence cavity 360 also includes a support structure 390 located generally along the axis 300 for reducing the cavity volume and guiding the liquid to the metering orifices.

The offset arrangement of the supply orifices and the metering orifices, as best illustrated in FIGS. 8 and 9, cause the atomized liquid expelled from each exhaust orifice to have momentum components that cause a swirling motion around the central axis 300 of the device. This swirling action includes momentum components tangential to the central flow axis 300 in order to promote better atomized particle mixing, and toward the central flow axis 300 in order to reduce the cone angle in generally the same manner as in the second preferred embodiment.

As with the first and second embodiments, the third embodiment includes sharp edges that define the supply and metering orifices for inducing additional vortices in the liquid flowing therethrough. The sharp edges of the supply and metering orifices are also designed such that the x/y ratio for each pair is greater than 0.5 in order to produce atomized particle sizes of minimum SMD as explained above.

Several other significant differences between this embodiment and the first and second embodiments include: (1) the angular momentum induced into the liquid flow results in a narrower cone angle without sacrificing droplet size, and (2) two supply orifices, one primary and one secondary, feed each metering orifice such that the flows will interact to cause a complex swirling of the liquids ejected from each metering orifice.

In the geometry used for the third preferred embodiment illustrated in FIGS. 6–10, the optimum x/y ratio is 2 which includes an x dimension of 200 and a y dimension of 100 microns. The size of the supply orifices are 200 microns by 400 microns, while the size of the metering orifices is 212 microns square. This configuration produces SMD of approximately 60 microns and a cone angle of 20 to 25 degrees. The injector was fabricated from a silicon wafer having a crystal orientation of 100 and a thickness of approximately 400 microns. The angles of the vortex inducing edges can range from approximately 50 degrees to approximately 60 degrees, with 54 to 55 degrees being the preferred angle for purposes of the development of the present invention.

In the first, second and third preferred embodiments, a plurality of hillocks 1 are included in each turbulence cavity for the purpose of creating additional vortices in the liquid flowing therethrough. The positions of the hillocks 1 illustrated in each of the embodiments have been chosen to optimize the atomization process while minimizing the induced backpressure and clogging potential.

The hillocks 1 can be manufactured into either or both of the inward facing sections of the turbulence generator plates 140, 240 and 340 and the metering plates 120, 220, 320 by using well known micromachining processing techniques. The hillocks are masked and the remaining sections of the plates are removed in order to leave the vortex inducing protrusions or spires that rise into the turbulence cavity. While a four sided pyramid shape is illustrated as the preferred shape for silicon materials, hillocks of various cross-sections, heights and spacings (such as rounded bumps, ridges, truncated spires, mesas, etc.) can be utilized as appropriate for the intended application. If either the turbulence generator plate or the metering plate are metal, then the hillocks can be manufactured therein by knurling or other similar processes.

Other important aspects of the hillocks include: (1) they introduce additional turbulence in the liquids flowing through the turbulence cavity, thereby tending to reduce the droplet size of the atomized liquid, and (2) when they are properly located, as illustrated in the drawings, the hillocks aid in the reduction of the resulting cone angle without degrading the droplet size of the atomized liquid.

Of course, the size of the metering orifices will determine the flow rate through the injector. The size of the supply orifice must be chosen so as to satisfy the desired x/y ratio while remaining large enough to avoid choking or clogging. Empirical data indicate that the area of the supply orifice should be at least twice the area of the metering orifice to attain good operating reliability.

While particular embodiments of the invention have been illustrated and described, it will be obvious to those skilled in the art that various changes and modifications may be made without departing from the invention, and it is intended to cover in the appended claims all such modifications and equivalents of fall within the true spirit and scope of this invention.

We claim:

1. An apparatus for improving the atomization quality of fuel flowing from a fuel injector of the type used in the fuel system of an internal combustion engine, comprising:

a body having first and second turbulence cavities defined therein, first and second supply orifices defined in said body coupled into corresponding ones of said first and second turbulence cavities for guiding the flow of fuel thereinto, first and second metering orifices defined in said body coupled from corresponding ones of said first and second turbulence cavities for exhausting the atomized fuel therefrom in corresponding first and second fuel flows, first vortex means coupled within said body adjacent said first supply orifice for generating a vortex turbulence immediately adjacent said first metering orifice for enhancing the atomization of and for inducing in said first fuel flow a first lateral momentum component generally transverse to the direction of said first fuel flow in said first supply orifice, second vortex means coupled within said body adjacent said second supply orifice for generating a vortex turbulence immediately adjacent said second metering orifice for enhancing the atomization of and for inducing in said second fuel flow a second lateral momentum component generally transverse to the direction of said second fuel flow in said second supply orifice, with said first and second vortex means each comprising one rim of a corresponding one of said first and second supply orifices paired with a second rim of an adjacent corresponding one of said metering orifices, with said one rim being located upstream by a distance y and laterally offset by a distance x from said second rim such that the x/y ratio is greater than 0.1 but less than 5, and with said supply orifices, vortex means, turbulence cavities and metering orifices being sized and spaced in said body such that said first and second lateral momentum components in said first and second fuel flows cooperate and at least partially oppose each other for reducing the resultant cone angle of the atomized fuel flowing from the injector.

2. The apparatus described in claim 1 wherein said first and second supply orifices are spaced from central flow axis of the injector further than said first and second metering orifices are spaced from said central flow axis for directing said first and second lateral momentum components inward toward said central supply axis.

3. The apparatus described in claim 1 wherein said first and second lateral momentum components in said first and second fuel flows cooperate and are at least partially tangential to each other for producing a swirling action in the resultant cone angle of the atomized fuel flowing from the injector.

4. The apparatus described in claim 1 wherein said body further includes a plurality of hillock means thereon for inducing multiple sources of minor turbulence in the fuel flowing within said first and second turbulence cavities for further enhancing the atomization of the fuel prior to flowing through one of said metering orifices.

5. The apparatus described in claim 1 wherein said first and second vortex means each comprises a sharp protruding edge of less than 90° included angle.

6. An apparatus for improving the atomization quality of fuel flowing from a fuel injector of the type used in the fuel system of an internal combustion engine, comprising:

a body having first and second turbulence cavities defined therein, said body further including a plurality of hillock means therein for inducing multiple sources of minor turbulence so as to further enhance the atomization of fuel flowing therethrough, first and second supply orifices in said body coupled into corresponding ones of said first and second turbulence cavities for guiding the flow of fuel thereinto, first and second metering orifices in said body coupled from corresponding ones of said first and second turbulence cavities for exhausting the atomized fuel therefrom in first and second fuel flows, first vortex means coupled within said body adjacent said first supply orifice for generating a turbulence adjacent said first metering orifice for enhancing the atomization of and for inducing in said first fuel flow a first lateral momentum component generally transverse to the direction of said first fuel flow, second vortex means coupled within said body adjacent said second supply orifice for generating a turbulence adjacent said second metering orifice for enhancing the atomization of and for inducing in said second fuel flow a second lateral momentum component generally transverse to the direction of said second fuel flow, with said first and second vortex means each comprising one rim of said supply orifice paired with a second rim of an adjacent one of said metering orifices, with said one rim being located upstream by a distance y and laterally offset by a distance x from said second rim such that x/y is greater than 0.5 but less than 5, with said supply orifices, vortex means, turbulence cavities and metering orifices being sized and spaced in said body such that said first and second lateral momentum components in said first and second fuel flows combine to control the resultant cone angle of the fuel flowing from the injector.

7. A method for controlling the cone angle of fuel exiting from an injector of the type used in an internal combustion engine, comprising the steps of:

(a) inducing a first turbulence in the fuel flowing past a first protrusion in at least one supply orifice which defines a flow axis therein, (b) guiding the fuel through a turbulence cavity and then out through a first metering orifice having another protrusion positioned downstream from the first protrusion by a distance y measured parallel to the flow axis and by a distance x measured perpendicular to the flow axis, thereby imparting to the fuel a lateral momentum component in the x direction, and (c) controlling the droplet size of the atomized fuel exiting from the first metering orifice in a first flow by maintaining the x/y ratio greater than 0.1, and (d) repeating steps a, b and c for inducing a source of second turbulence and lateral momentum in a second flow of fuel from a second metering orifice, and (e) directing the second flow for at least partially intersecting with the first flow such that the lateral momentum in the first and second flows cooperate for reducing the resulting lateral momentum of the first and second flows, thereby reducing the cone angle of the resulting atomized fuel flow exiting the injector.

8. The method as described in claim 7 wherein step (a) includes the step of inducing turbulence by flowing the fuel over a protruding edge of less than 90° included angle forming a portion of the supply orifice and an adjacent wall of the turbulence cavity.

9. The method as described in claim 1 wherein step (b) includes the step of inducing another source of turbulence adjacent the metering orifices for enhancing the atomization of the fuel flowing therethrough.

10. The method as described in claim 7 wherein step (b) includes the step of flowing the fuel over a protruding edge of less than 90° included angle forming a portion of the metering orifice and an adjacent wall of the turbulence cavity.

11. The method as described in claim 7 wherein step (c) further includes the step of maintaining the first turbulence immediately adjacent to and upstream in the fuel flow from the metering orifice.

12. The method as described in claim 7 wherein step (c) includes the step of maintaining the x/y dimensional ratio to be greater than 0.5 but less than 5, thereby minimizing the droplet size of the atomized fuel exiting from the metering orifice.

13. The method as described in claim 7 wherein step (e) further includes the step of directing the first and second flows for at least partially intersecting each other such that the momentum components of each flow interact for swirling the fuel and controlling the cone angle of the atomized fuel exiting the injector.

14. The method as described in claim 7 wherein step (a) further includes the substeps of inducing multiple sources of minor turbulence in the fuel flowing around hillocks in the turbulence cavity and downstream from the first turbulence for further enhancing the atomization of the fuel prior to flowing through the metering orifice.

15. A method for controlling the cone angle of fuel exiting from an injector of the type used in an internal combustion engine, comprising the steps of:

(a) inducing a first turbulence in the fuel flowing past a first protrusion in at least one supply orifice which defines a flow axis therein, (b) guiding the fuel through a turbulence cavity and then out through a first metering orifice having another protrusion positioned downstream from the first protrusion by a distance y measured parallel to the flow axis and by a distance x measured perpendicular to the flow axis, thereby imparting to the fuel a lateral momentum component in the x direction, and (c) controlling the droplet size of the fuel exiting from the first metering orifice in a first flow by maintaining the x/y ratio greater than 0.1, and (d) repeating steps a, b and c for inducing a source of second turbulence and lateral momentum in a second flow of fuel from a second metering orifice, and (e) directing the second flow for at least partially intersecting with the first flow such that the resulting momentum components in the first and second flows interact for swirling the fuel and controlling the cone angle of the resulting atomized fuel flow exiting the injector.

16. The method as described in claim 15 wherein step (a) includes the step of inducing turbulence by flowing the fuel over a protruding edge of less than 90° included angle forming a portion of the supply orifice and an adjacent wall of the turbulence cavity.

17. The method as described in claim 15 wherein step (b) includes the step of inducing another source of turbulence adjacent the metering orifices for enhancing the atomization of the fuel flowing therethrough.

18. The method as described in claim 15 wherein step (b) includes the step of flowing the fuel over a protruding edge of less than 90° included angle forming a portion of the metering orifice and an adjacent wall of the turbulence cavity.

19. The method as described in claim 15 wherein step (c) includes the step of maintaining the x/y dimensional ratio to be greater than 0.5 but less than 5, thereby minimizing the droplet size of the atomized fuel exiting from the metering orifice.

* * * * *